US006729257B2

(12) United States Patent
Nakajima et al.

(10) Patent No.: US 6,729,257 B2
(45) Date of Patent: May 4, 2004

(54) PERSONAL WATERCRAFT

(75) Inventors: Jun Nakajima, Saitama (JP); Tadaaki Nagata, Saitama (JP); Koji Mizuta, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/283,142

(22) Filed: Oct. 30, 2002

(65) Prior Publication Data

US 2003/0131776 A1 Jul. 17, 2003

(30) Foreign Application Priority Data

Oct. 31, 2001 (JP) ..... 2001-335629

(51) Int. Cl.[7] ..... B63B 35/73
(52) U.S. Cl. ..... 114/55.51
(58) Field of Search ..... 114/55.5, 55.51, 114/55.53, 55.57

(56) References Cited

U.S. PATENT DOCUMENTS 4,982,682 A * 1/1991 Hattori ..... 114/55.51
6,530,336 B2 * 3/2003 Ibata et al. ..... 114/55.5

OTHER PUBLICATIONS

Patent Abstracts of Japan, JP–11–278387, Oct. 12, 1999, "Water Penetration Preventing Device for Internal Combustion Enginge in Ship," Nanami Masayoshi.

* cited by examiner

*Primary Examiner*—Sherman Basinger
(74) *Attorney, Agent, or Firm*—Birch, Stewart, Kolasch & Birch, LLP

(57) ABSTRACT

A personal watercraft wherein air is introduced into a body through a gap formed between the body and a front hood and prohibiting permeation of sea water or other water in the body through the gap. A personal watercraft is basically configured such that a handlebar is disposed on the center line in the width direction of a body, a front hood for covering an upper front portion of the body is disposed in front of the handlebar, and left and right side covers are disposed at left and right lower edges of the front hood, respectively, wherein air is introduced into an in-body space through left and right gaps S between the side covers and the front hood. This personal watercraft includes left and right labyrinth structures for allowing an introduction of air into the in-body space and prohibiting permeation of water in the in-body space are provided in the gaps S between the front hood and the side covers, respectively.

14 Claims, 7 Drawing Sheets

PERSONAL WATERCRAFT

CROSS-REFERENCE TO RELATED APPLICATIONS

The present nonprovisional application claims priority under 35 USC 119 to Japanese Patent Application No. 2001-335629 filed on Oct. 31, 2001 the entire contents thereof is hereby incorporated by reference.

BACKGROUND OF THE INVENTION

1. Field of the Invention

The present invention relates to a personal watercraft in which an upper front portion of a body is covered with a front hood and left and right side covers are disposed at left and right lower edges of the front hood, respectively, wherein air is introduced into the body through gaps between the left and right side covers and the front hood.

2. Description of Background Art

Personal jet propulsion watercrafts include a jet pump mounted to a rear portion of a body wherein the jet pump is driven by an engine. In these jet propulsion watercrafts, water is sucked by driving the jet pump and is jetted rearwardly, to thereby propel the watercraft.

In the personal watercrafts of this type, since the engine is disposed in a body, air to be supplied to the engine must be introduced in the body. Such a personal watercraft has been disclosed, for example, in Japanese Patent Laid-open No. Hei 11-278387 entitled "Apparatus for Preventing Permeation of Water in Internal Combustion Engine for Watercraft." The configuration of this personal watercraft will be described in detail below with reference to FIG. 7 of the drawings which corresponds to FIG. 2 of Japanese Patent Laid-open No. Hei 11-278387. It is to be noted that in FIG. 7 parts are denoted by new reference numerals.

FIG. 7 is a sectional view of the above-described related art personal watercraft. The personal watercraft 100, is configured as follows. A handlebar 102 is disposed on a front portion 101*a* of a body 101 and a luggage box 103 is disposed in front of the handlebar 102. An upper end opening 103*a* of the luggage box 103 is covered with a cover (front hood) 104. A hinge (not shown) that allows a swinging motion of the front hood 104 in the vertical direction is provided at a front end portion 104*a* of the front hood 104. A gap (not shown) is formed between the front hood 104 and the body 101. An intake duct 105 in communication with the gap is provided behind the luggage box 103.

According to the personal watercraft 100, air flowing into the gap between the front hood 104 and the body 101 is led in an inlet of the intake duct 105 as shown by an arrow "a" and is then introduced from an outlet of the intake duct 105 in the body 101 as shown by an arrow "b," to be thus supplied to an engine (not shown).

However, the personal watercraft, in which the gap for introducing air in the body 101 is formed between the front hood 104 and the body 101, has a problem that is caused when sea water or other water is splashed on the front hood 104 and the body 101 during propulsion of the personal watercraft 100. To be more specific, when sea water or other water is splashed on the front hood 104 and the body 101, there may occur an inconvenience in that the splashed water flows into the gap, and permeates in the body 101 through the intake duct 105.

SUMMARY AND OBJECTS OF THE INVENTION

Accordingly, an object of the present invention is to provide a personal watercraft for allowing an introduction of air into a body through a gap formed between the body and a front hood and prohibiting permeation of sea water or other water into the body through the gap.

To solve the above object, according to the present invention, there is provided a personal watercraft in which a handlebar is disposed on the center line in the width direction of the body, a front hood for covering an upper front portion of the body is disposed in front of the handlebar and left and right side covers are disposed at left and right lower edges of the front hood, respectively. Air is introduced in the body through gaps between the side covers and the front hood. The personal watercraft includes a labyrinth structure for allowing the introduction of air into the body and prohibiting a permeation of water in the body. The labyrinth structure is provided in each of the gaps between the front hood and the side covers.

Since the labyrinth structure is provided in each of the gaps formed between the front hood and the side covers, it is possible to prohibit a permeation of water into the body through the gaps while allowing an introduction of air into the body through the gaps.

Accordingly, even if sea water or other water is splashed on the front hood and the body during propulsion of the personal watercraft, it is possible to prevent a permeation of the splashed water into the body through the gaps.

According to the present invention, the labyrinth structure is configured such that a plurality of shield plates are provided at an upper end of each of the side covers in such a manner so as to be tilted at a rising gradient in the direction from the front side to the rear side of the body.

To form the labyrinth structure, the plurality of shield plates are provided at an upper end of each of the side covers in such a manner so as to be tilted at a rising gradient in the direction from the front side to the rear side of the body. Accordingly, the labyrinth structure can be simply formed only by disposing the plurality of shield plates.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be hereinafter described with reference to the accompanying drawings. It is to be noted that the drawings should be viewed in the direction of characters.

Figure 1:
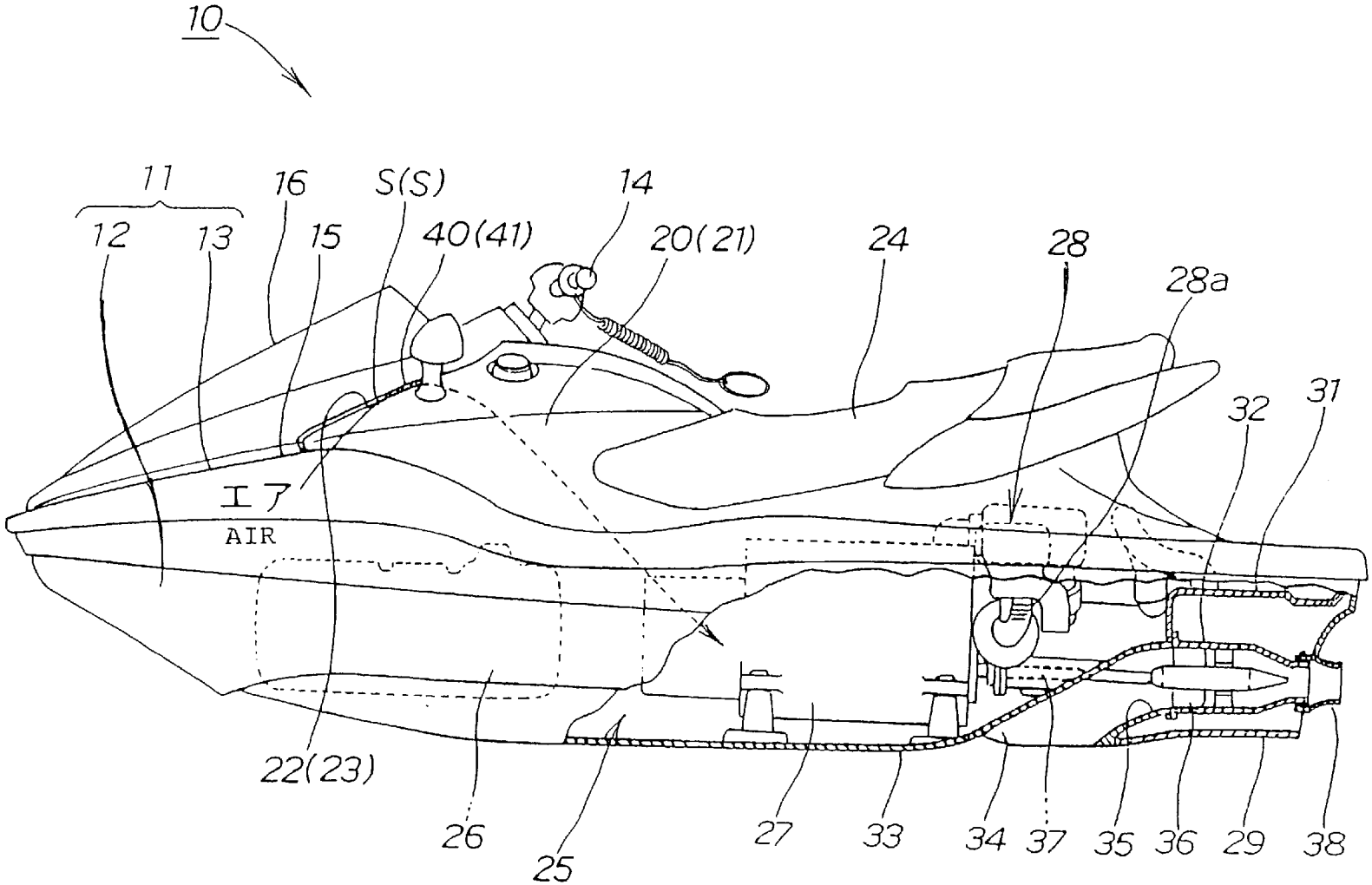
FIG. 1 is a side view of a personal watercraft of the present invention.

FIG. 1 is a side view of a personal watercraft of the present invention. A personal watercraft 10 is configured as a jet propulsion watercraft, which includes a body 11 composed of a hull 12 constituting a lower portion of the body 11 and a deck 13 constituting an upper portion of the body 11. A steering handlebar (handlebar) 14 is disposed on the centerline in the width direction of the body 11. A front hood 16 for covering an upper front portion 15 of the body 11 is disposed in front of the steering handlebar 14. Upper front portions 22 and 23 of the left and right side covers 20 and 21 are disposed under a lower rear portion of the front hood 16. A saddle-type seat 24 is disposed behind the left and right side covers 20 and 21. A fuel tank 26 is disposed in an in-body space 25 at a position in front of and under the seat 24. An engine 27 is also disposed in the in-body space 25 at a position behind the fuel tank 26. An intake system is disposed on a side surface of the engine 27, and a longitudinally-elongated air box 28 is provided on the intake system. A jet propulsion chamber 31 is provided at a stern 29 behind the engine 28, and a jet propulsion unit 32 is provided in the jet propulsion chamber 31.

The personal watercraft 10 configured as described above includes a left gap S that is provided between the front hood 16 and the left side cover 20 and similarly a right gap S is provided between the front hood 16 and the right side cover 21. A left labyrinth structure 40 is provided in the left gap S and similarly a right labyrinth structure 41 is provided in the right gap S. Each of the left and right labyrinth structures 40 and 41 is configured to allow an introduction of air into the in-body space 25 through the gap S and to prohibit permeation of sea water or other water into the in-body space 25 via the gap S.

The jet propulsion unit 32 has a housing 35 extending rearwardly from an inlet 34 of a bottom 33 of the hull 12. An impeller 36 is rotatably mounted in the housing 35 wherein the impeller 36 is connected to a drive shaft 37 of the engine 27.

Figure 4:
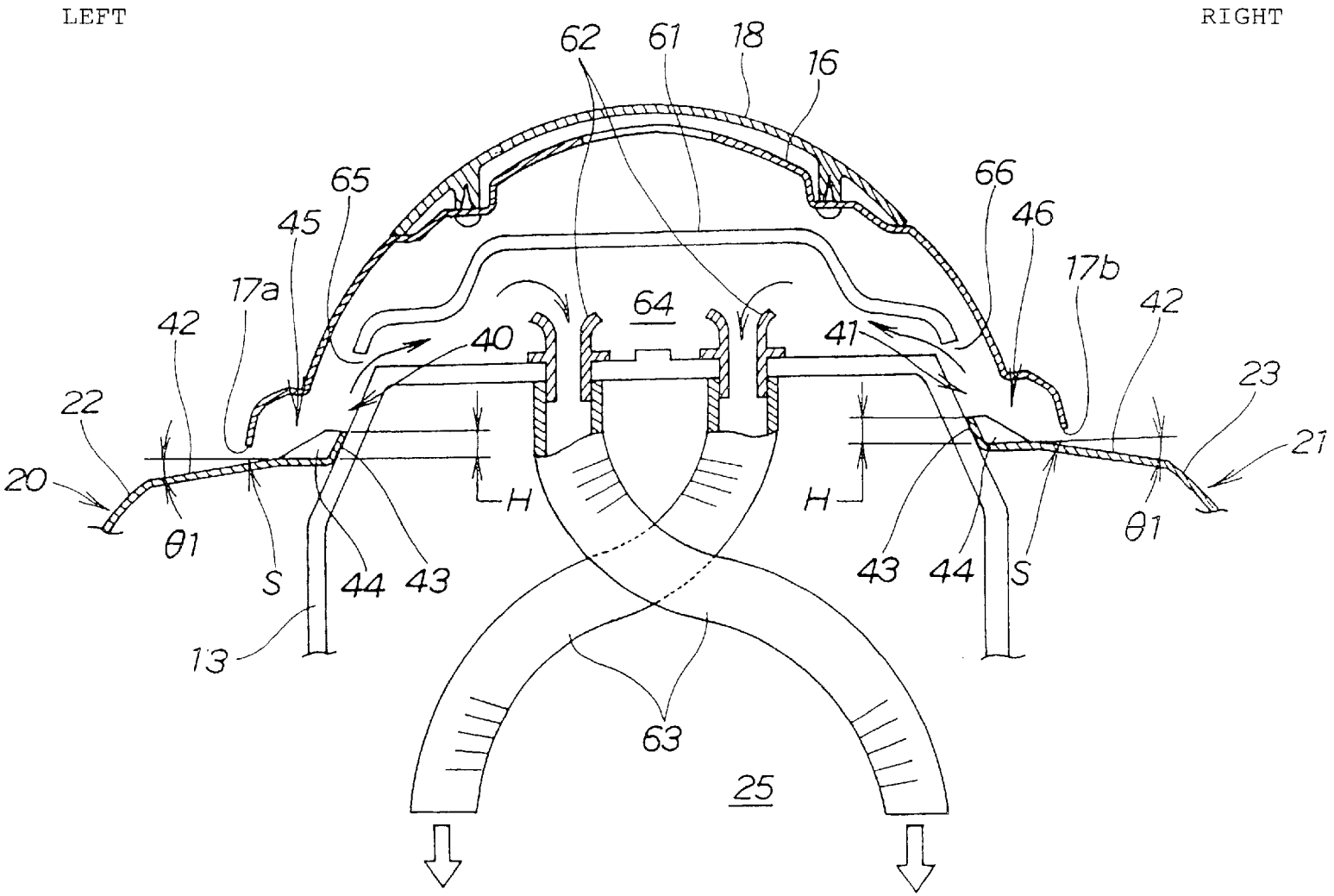
FIG. 4 is a sectional view taken on line 4—4 of FIG. 2.

In the case of propelling the personal watercraft 10, air is directed into the body 11 through the gaps S between the left and right side covers 20 and 21 and the front hood 16 as shown by an arrow, and is then introduced into the in-body space 25 via a pair of intake ducts 62 and a pair of intake hoses 63 (see FIG. 4). Thus, the air introduced into the in-body space 25 is sucked in the air box 28 and is supplied from the air box 28 into a cylinder (not shown) of the engine 27 via an intake pipe 28*a*.

The engine 27 is driven, and the rotation of the engine 27 is transmitted to the drive shaft 37, to rotate the impeller 36. With this rotation of the impeller 36, water is sucked from the inlet 34 of the bottom 33 and is then led as jet water in a steering nozzle 38 via the housing 35.

The jet water thus led in the steering nozzle 38 is jetted from the steering nozzle 38, to propel the personal watercraft 10.

Figure 2:
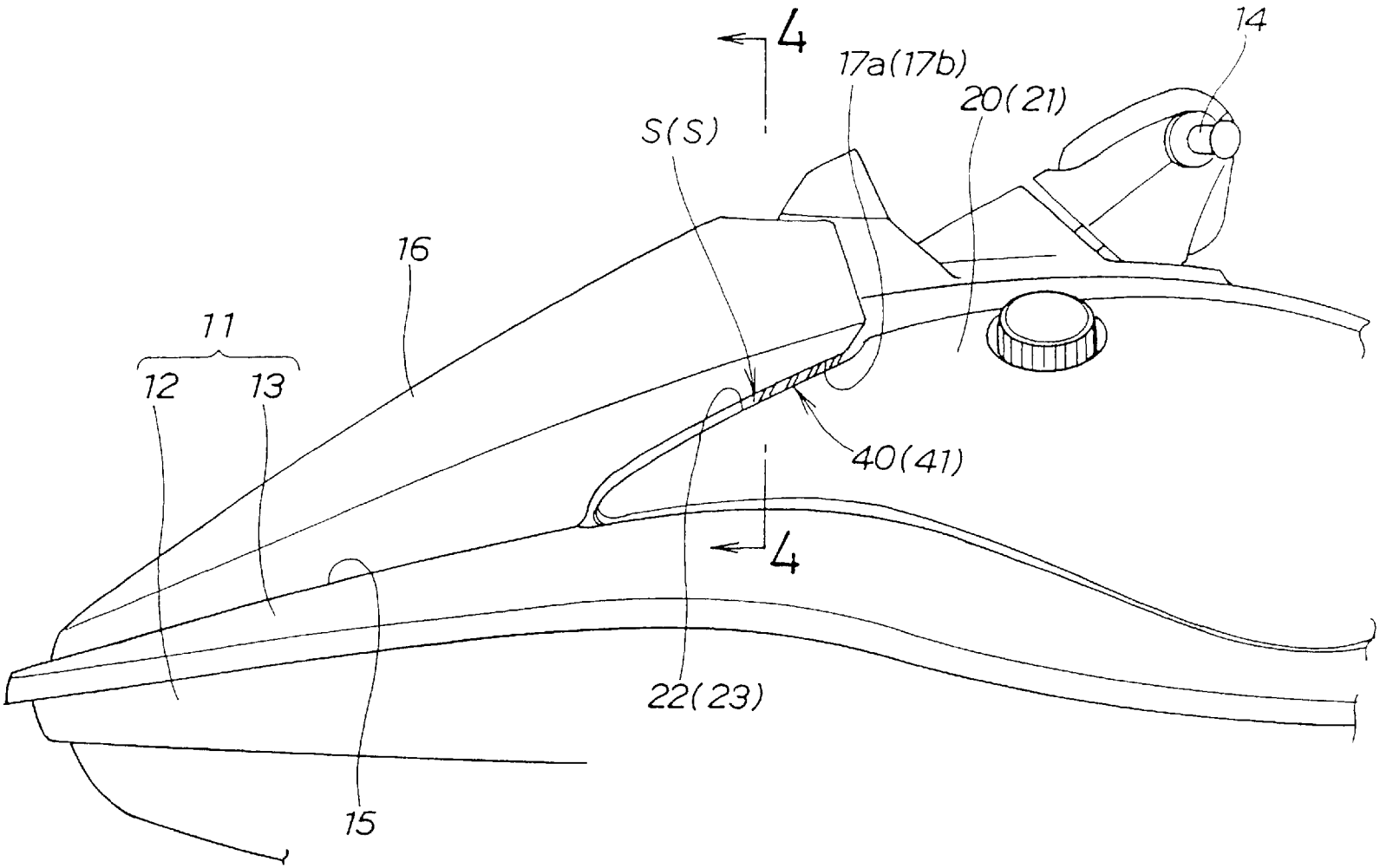
FIG. 2 is a side view showing an essential portion of the personal watercraft of the present invention.

FIG. 2 is a side view showing an essential portion of the personal watercraft of the present invention showing a state wherein the upper front portion 15 of the body 11 is closed with the front hood 16.

When the front hood 16 is closed, the lower rear portion of the front hood 16 is placed on the upper front portions 22 and 23 of the left and right side covers 20 and 21. At this time, the left and right gaps S are formed between left and right lower rear edges 17*a* and 17*b* of the front hood 16 and the upper front portions 22 and 23 of the left and right side covers 20 and 21, respectively. The left and right labyrinth structures 40 and 41 are provided in the left and right gaps S, respectively.

Figure 3:
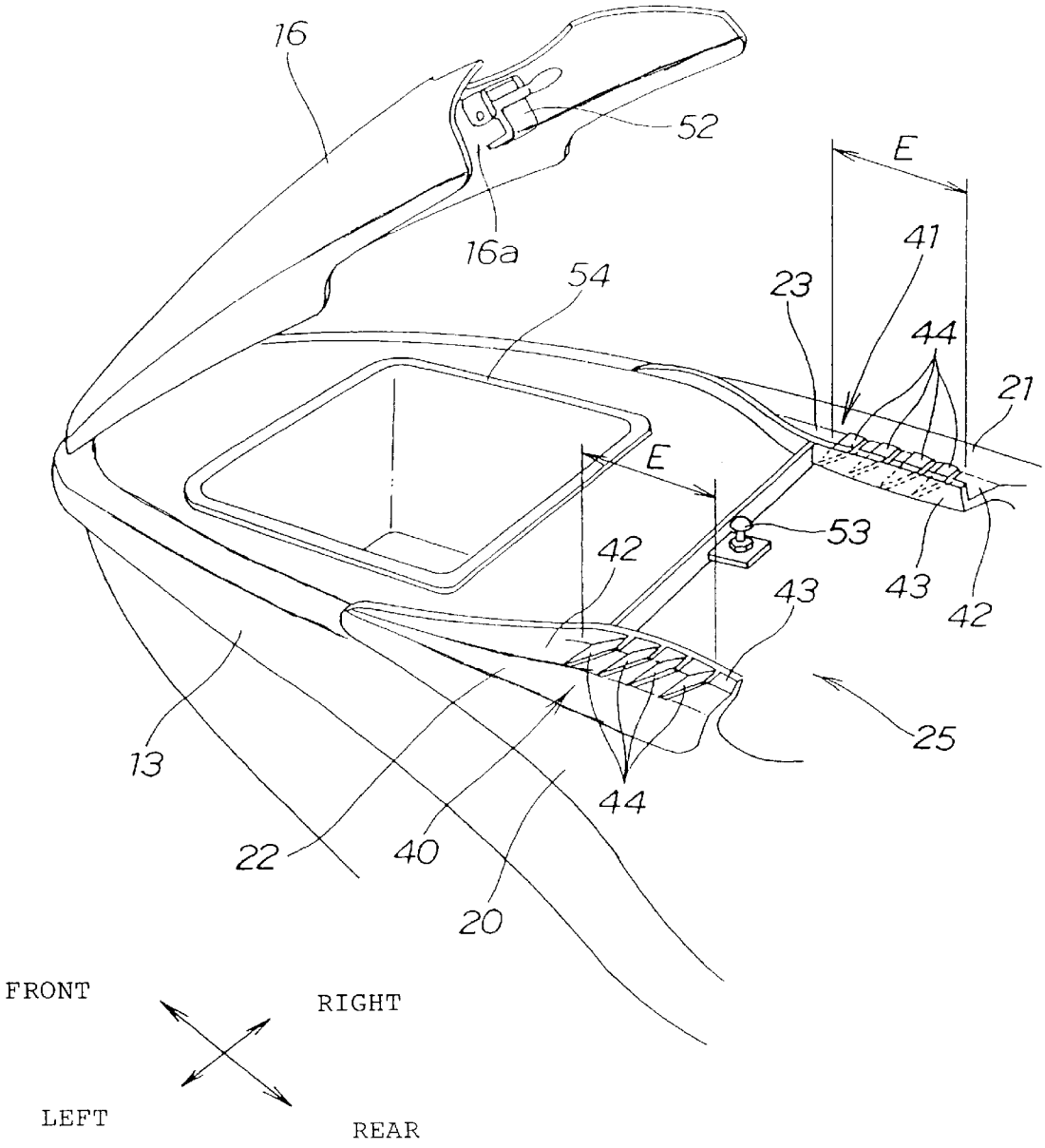
FIG. 3 is a perspective view showing an essential portion of the personal watercraft of the present invention.

FIG. 3 is a perspective view showing an essential portion of the personal watercraft of the present invention, showing a state wherein the front hood 16 is opened around a hinge (not shown) provided, as a turning axis, at a front end of the front hood 16.

The front hood 16 is opened by releasing a latch 52 mounted to a rear end of the front hood 16 from a locking member 53 on the deck 13 side and lifting up the front hood 16 around the hinge as the turning axis. Since a lid body (not shown) of a luggage box 54 is mounted to a back surface 16*a* of the front hood 16, the luggage box 56 can be opened by lifting up the front hood 16.

The left and right side covers 20 and 21 have the left and right upper front portions 22 and 23, respectively. The left upper front portion 22 has a horizontal plane 42 and a vertical plane 43. The horizontal plane 42 is bent towards the center of the body 11 nearly in the horizontal direction. The vertical plane 43 is bent from an inner end of the horizontal plane 42 nearly in the vertical direction. Four shield plates 44 . . . (symbol " . . . " indicates a plural number) are fixed to the horizontal plane 42 and the vertical plane 43 in such a manner so as to be spaced from each other at specific intervals. In this case, each of the shield plates 44 is tilted at a rising gradient in the direction from the front side to the rear side of the body 11.

The right upper front portion 23 of the right side cover 21 has the same configuration as that of the left upper front portion 22 of the left side cover 20. Therefore, parts associated with the right upper front portion 23 are denoted by the same reference numerals as those of the corresponding parts associated with the left upper front portion 22, and the overlapped description thereof is omitted.

FIG. 4 is a sectional view taken on line 4—4 of FIG. 2, showing a state wherein air is introduced into the in-body space 25. The left and right side covers 20 and 21 are disposed on the left and right sides of the deck 13 constituting the upper portion of the body 11. A post cover 61 is provided between the deck 60 and the front hood 16, to form a chamber 64. The chamber 64 includes left and right openings 65 and 66. A hood cover 18 is provided over the front hood 16. A pair of intake ducts 62 are mounted to the deck 13 in such a manner so as to be opened to the chamber 64. A pair of hoses 63 are connected to the intake ducts 62, to communicate the pair of intake ducts 62 to the in-body space 25.

FIG. 4 also shows a state wherein the left and right gaps S are formed between the horizontal planes 42 of the left and right side covers 20 and 21 and the left and right lower rear edges 17*a* and 17*b* of the front hood 16. The left and right labyrinth structures 40 and 41 are provided in left and right gaps S which are continuous to the left and right gaps S, respectively.

The left and right labyrinth structures 40 and 41 are, as shown in FIG. 3, provided in areas E of the left and right side covers 20 and 21, respectively. The reason for this is as follows: namely, although sea water or other water may enter in the left and right openings 65 and 66 formed at the left and right ends of the chamber 64 (see FIG. 4) and then permeate in the pair of intake ducts 62, the left and right openings 65 and 66 are located at positions corresponding to the areas E.

The positions at which the left and right labyrinth structures 40 and 41 are provided, however, are not limited to the areas E but may be any other positions within the scope of the present invention.

According to the personal watercraft 10 configured as described above, air having entered in the left and right gaps S through the left and right gaps S is directed into the pair of intake ducts 62 as shown by the arrows. The air passes through the intake hoses 63 connected to the intake ducts 62, to be introduced into the in-body space 25 from outlets of the intake hoses 63.

The left labyrinth structure 40 is configured such that the shield plates 44 . . . are fixed to the horizontal plane 42 of the left side cover 20 and the vertical plane 43 are bent vertically from the inner end of the horizontal plane 42 in such a manner so as be tilted at a rising gradient in the rearward direction. A height H of the vertical plane 43 and heights H of the shield plates 44 . . . are each set to be larger than the height of the gap S, whereby the left space 45 is brought into a labyrinth state.

In addition, with respect to the labyrinth structure, the horizontal plane 42 is tilted at a falling gradient of an angle θ1 toward the outer side of the body 11. The reason for this will be described later.

The right labyrinth structure 41 has the same configuration as that of the left labyrinth structure 40, and therefore, parts associated with the right labyrinth structure 41 are denoted by the same reference numerals as those of the corresponding parts associated with the left labyrinth structure 40, and the overlapped description thereof is omitted.

The left labyrinth structure 40 will be more fully described with reference to FIG. 5.

Figure 5:
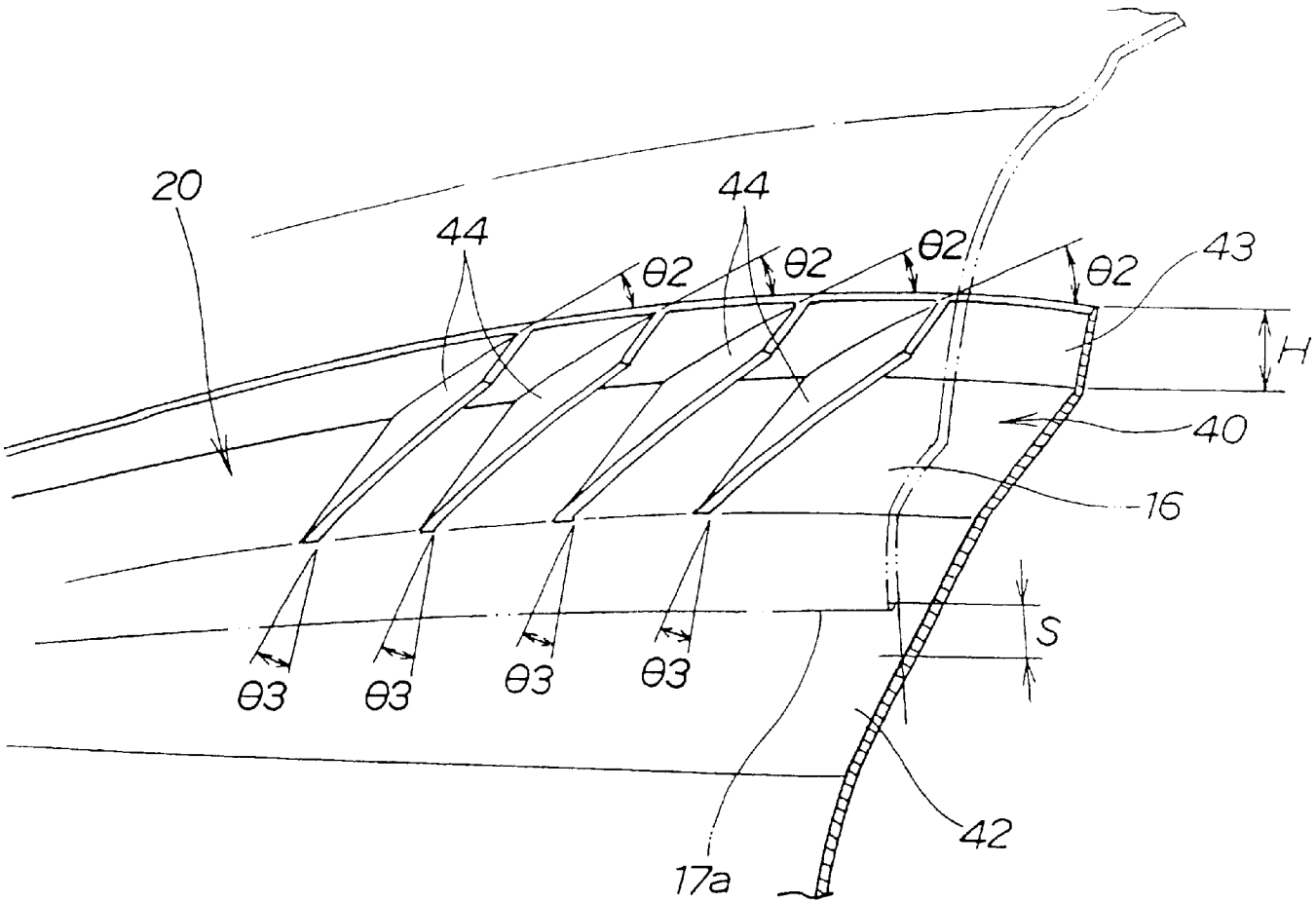
FIG. 5 is a perspective view showing an essential portion of the personal watercraft of the present invention.

FIG. 5 is a perspective view showing an essential portion of the personal watercraft of the present invention, showing the left labyrinth structure 40.

The four shield plates 44 . . . are fixed to the horizontal plane 42 and the vertical plane 43 of the left side cover 20 in such a manner so as to be spaced from each other at the specific intervals. In this case, the shield plates 44 . . . are tilted, in a side view, at a rising gradient of an angle θ2 in the direction from the front side to the rear side of the body 11 and are, in a plan view, tilted at a falling gradient of an angle θ3 toward the outer side of the body 11. The horizontal plane 42 and the vertical plane 43 of the left side cover 20 and the four shield plates 44 . . . are covered with the front hood 16. With this configuration, the height of the left gap S between the horizontal plane 42 of the left side cover 20 and the left lower rear edge 17*a* of the front hood 16 becomes smaller than each of the height H of the vertical plane 43 of the left side cover and the height H of the shield plates 44. The left labyrinth structure 40 is thus provided in the left space 45.

Since the left labyrinth structure 40 can be simply provided by mounting the shield plates 44 . . . at the upper end of the left side cover 20 in such a manner that the shield plates 44 . . . are tilted at the rising gradient, it is possible to suppress an increase in the production cost of the personal watercraft.

The left labyrinth structure 40 provided in the left space 45 is advantageous in prohibiting sea water or other water from entering into the left space 45 through the left gap S from permeating in the in-body space 25.

On the other hand, the left labyrinth structure 40 allows air having entered in the left space 45 through the left gap S to flow into the in-body space 25 over the labyrinth structure 40 (that is, the shield plates 44 . . . and the vertical plane 43).

The function of the personal watercraft will be described with reference to FIGS. 6(*a*) and 6(*b*).

Figure 6A:
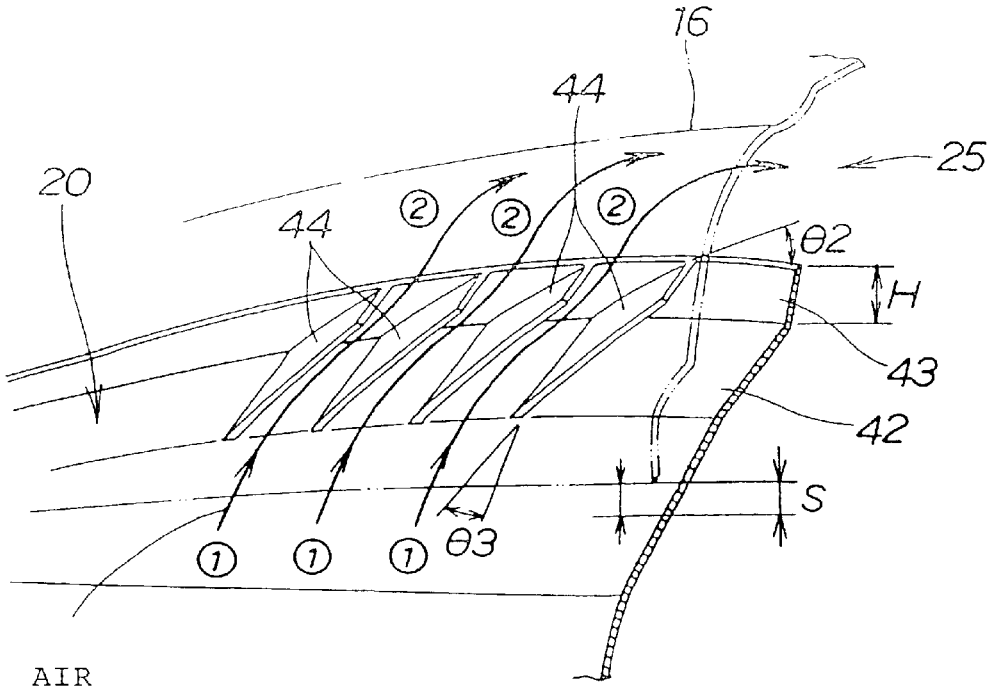
FIGS. 6(*a*) and 6(*b*) are views illustrating the function of the personal watercraft of the present invention.
Figure 6B:
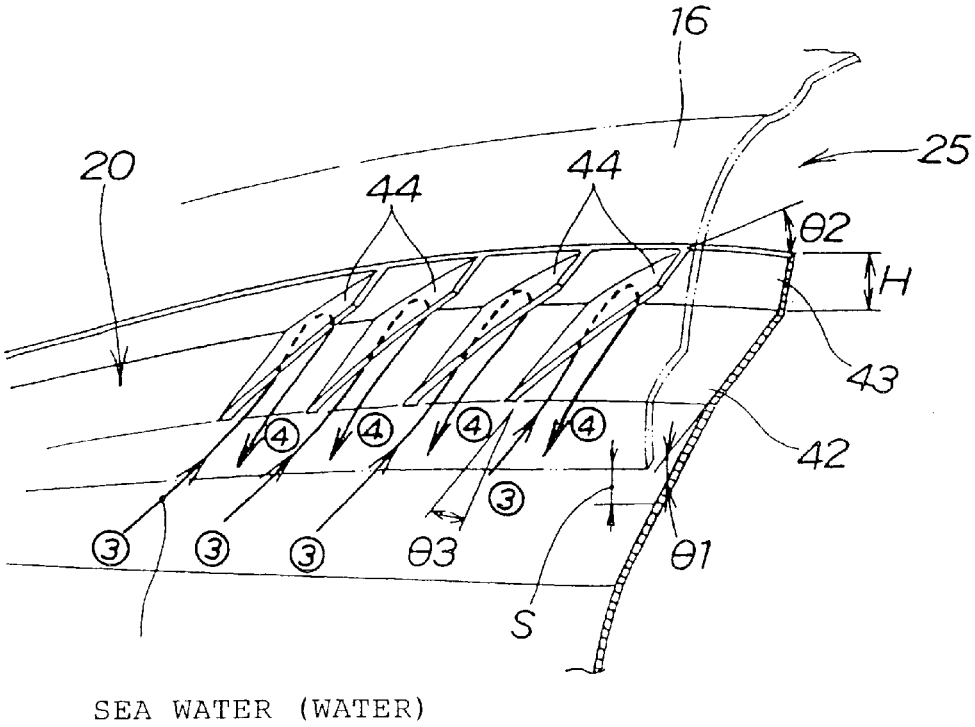
Figure 7:
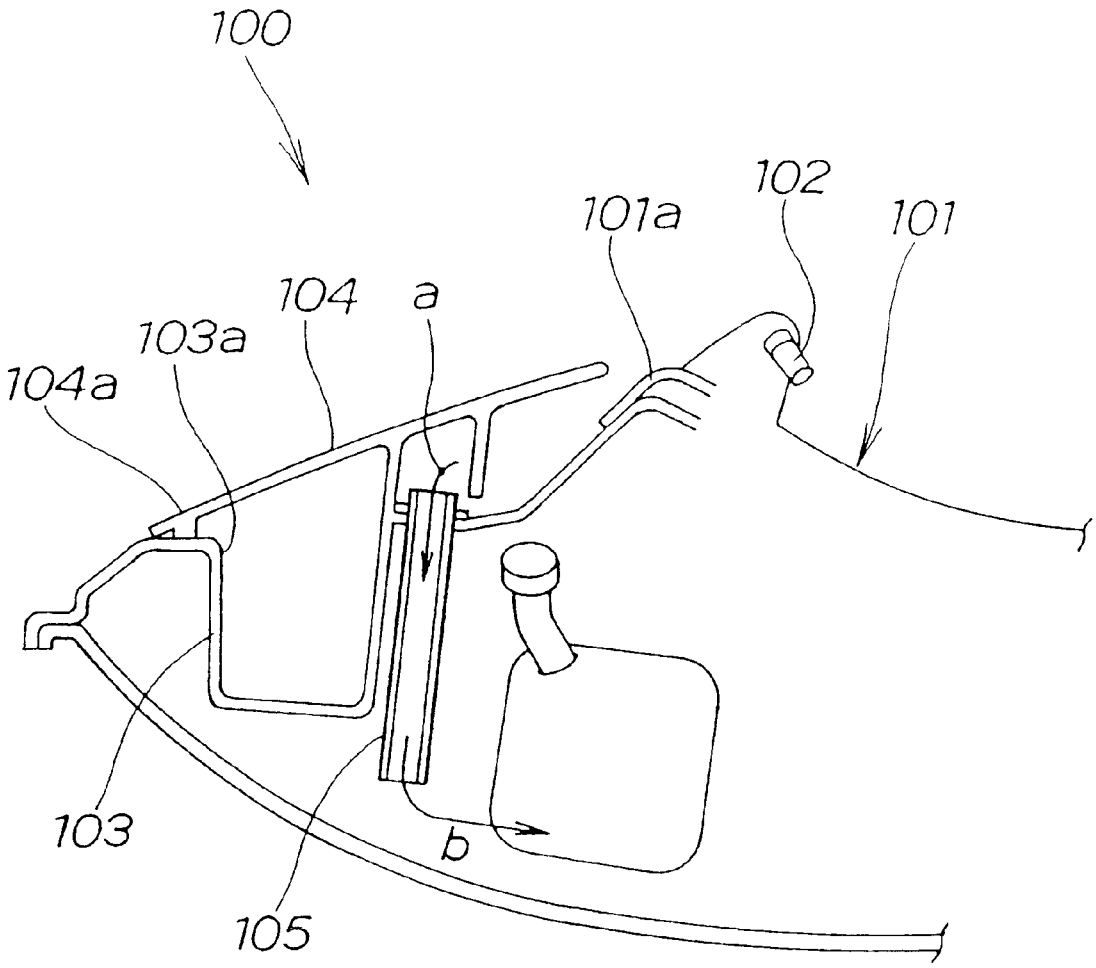
FIG. 7 BACKGROUND ART
FIG. 7 is a sectional view of a related art personal watercraft.

FIGS. 6(*a*) and 6(*b*) are views illustrating the function of the personal watercraft of the present invention, wherein FIG. 6(*a*) shows the state wherein the labyrinth structure allows an introduction of air, and FIG. 6(*b*) shows the state wherein the labyrinth structure prohibits permeation of sea water or other water.

As shown in FIG. 6(*a*), air enters in the left space 45 through the left gap S as shown by arrows (1). The air having entered in the left space 45 passes over the left labyrinth structure 40 composed of the shield plates 44 . . . and the vertical plane 43 because it has a small specific gravity as compared with water, to be thus introduced into the in-body space 25 as shown by arrows (2).

Accordingly, it is possible to take air into the in-body space 25 through the left gap S, suck the air in the air box 28, and supply the air from the air box 28 to the engine 27 (see FIG. 1).

As shown in FIG. 6(*b*), sea water or other water enters in the left space 45 through the left gap S as shown by arrows (3). The water having entered into the left space flows in each space between two adjacent shield plates 44 . . . as shown by the arrows because the water has a larger specific gravity as compared with air.

Since the shield plates 44 . . . are, in a side view, tilted at the rising gradient of the angle θ2 in the direction from the front side to the rear side of the body 11, the water that flows in each space between adjacent two of the shield plates 44 . . . is prevented from flowing up by back surfaces 44*a* . . . of the shield plates 44 . . . , to thus flow to the vertical plane 43 along the horizontal plane 42.

Since the shield plates 44 . . . are, in a plan view, tilted at the falling gradient of the angle θ3 towards the outer side of the body 1, the water having reached the vertical plane 43 flows back toward the left gap S along the falling gradient of the angle θ3 of the shield plates 44 . . . as shown by arrows (4).

Since the horizontal plane 42 of the left side cover 20 is, in the vicinity of the left gap S, tilted at the falling gradient of the angle θ1 as described with reference to FIG. 4, the water having reached the vicinity of the left gap S efficiently flows into the left gap S along the horizontal plane 42, to is thus discharged outwardly from the body 11 through the left gap S. Accordingly, it is possible to prohibit the water from permeating into the in-body space 25.

In the embodiment, the height of the vertical plane 43 and the height of each of the shield plates 44 . . . are set to be equal to each other. However, the heights may be different from each other.

In the embodiment, the personal watercraft is exemplified by the jet propulsion watercraft 10 propelled by a jet pump. However, the propulsion means of the personal watercraft is not limited thereto.

The present invention having the above-described configuration exhibits the following effects:

According to the present invention, since the labyrinth structure is provided in each of the gaps formed between the front hood and the side covers, it is possible to prohibit permeation of water in the body through the gaps while allowing an introduction of air into the body through the gaps.

Accordingly, even if sea water or other water is splashed on the front hood and the body during propulsion of the personal watercraft, it is possible to prevent permeation of the splashed water into the body through the gaps.

According to the present invention, the labyrinth structure is configured such that a plurality of shield plates are provided at an upper end of each of the side covers in such a manner as to be tilted at a rising gradient in the direction from the front side to the rear side of the body. Since the labyrinth structure can be simply obtained only by providing the plurality of shield plates, it is possible to suppress the rise in production cost of the personal watercraft.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft, in which a handlebar is disposed on the centerline in the width direction of a body, a front hood for covering an upper front portion of said body is disposed in front of said handlebar, and left and right side covers are disposed at left and right lower edges of said front hood, respectively, wherein air is introduced into said body through gaps between said side covers and said front hood comprising:

a labyrinth structure for allowing an introduction of air into said body and prohibiting a permeation of water into said body is provided in each of said gaps between said front hood and said side covers, said labyrinth structure is configured such that a plurality of shield plates are provided at an upper end of each of said side covers in such a manner as to be tilted at a rising gradient in the direction from the front side to the rear side of said body.

2. The personal watercraft according to claim 1, wherein the plurality of shield plates include a plane that is tilted a predetermined angle at a falling gradient towards an outer side of the body.

3. The personal watercraft according to claim 1, wherein the plurality of shield plates include a plane that is tilted a predetermined angle at a falling gradient towards an outer side of the body and a vertical plane that is disposed at a predetermined angle in a rising gradient from a front side to a rear side of the body.

4. The personal watercraft according to claim 1, wherein the plurality of shield plates include a plane that is tilted a predetermined angle at a falling gradient towards an outer side of the body and a vertical plane that is disposed at a predetermined angle in a rising gradient from a front side to a rear side of the body and said vertical plane in a plan view is tilted at a falling gradient of a predetermined angle towards the outer side of the body.

5. The personal watercraft according to claim 1, wherein air entering the labyrinth structure flows into said body and water, having a larger specific gravity relative to air, is prevented from flowing through the gaps to enter into the body.

6. A vent for use with a personal watercraft comprising:

a front hood for covering an upper front portion of a body;

left and right side covers are disposed at left and right lower edges of said front hood, respectively, wherein air is introduced into said body through gaps between said side covers and said front hood;

a labyrinth structure for allowing an introduction of air into said body and prohibiting a permeation of water into said body is provided in each of said gaps between said front hood and said side covers, said labyrinth structure is configured such that a plurality of shield plates are provided at an upper end of each of said side covers in such a manner as to be tilted at a rising gradient in the direction from the front side to the rear side of said body.

7. The vent according to clam 6, wherein the plurality of shield plates include a plane that is tilted a predetermined angle at a falling gradient towards an outer side of the body.

8. The vent according to claim 6, wherein the plurality of shield plates include a plane that is tilted a predetermined angle at a falling gradient towards an outer side of the body and a vertical plane that is disposed at a predetermined angle in a rising gradient from a front side to a rear side of the body.

9. The vent according to claim 6, wherein the plurality of shield plates include a plane that is tilted a predetermined angle at a falling gradient towards an outer side of the body and a vertical plane that is disposed at a predetermined angle in a rising gradient from a front side to a rear side of the body and said vertical plane in a plan view is tilted at a falling gradient of a predetermined angle towards the outer side of the body.

10. The vent according to claim 6, wherein air entering the labyrinth structure flows into said body and water, having a larger specific gravity relative to air, is prevented from flowing through the gaps to enter into the body.

11. A personal watercraft, in which a handlebar is disposed on the centerline in the width direction of a body, a front hood for covering an upper front portion of said body is disposed in front of said handlebar, and left and right side covers are disposed at left and right lower edges of said front hood, respectively, wherein air is introduced into said body through gaps between said side covers and said front hood comprising:

a labyrinth structure for allowing an introduction of air into said body and prohibiting a permeation of water into said body is provided in each of said gaps between said front hood and said side covers, said labyrinth structure includes a plurality of shield plates including a plane that is tilted a predetermined angle at a falling gradient towards an outer side of the body.

12. The personal watercraft according to claim 11, wherein said plurality of shield plates are provided at an upper end of each of said side covers and are further tilted at a rising gradient in the direction from the front side to the rear side of said body.

13. The personal watercraft according to claim 11, wherein the plurality of shield plates include a vertical plane that is disposed at a predetermined angle in a rising gradient from a front side to a rear side of the body and said vertical plane in a plan view is tilted at a falling gradient of a predetermined angle towards the outer side of the body.

14. The personal watercraft according to claim 11, wherein air entering the labyrinth structure flows into said body and water, having a larger specific gravity relative to air, is prevented from flowing through the gaps to enter into the body.

* * * * *